US005984838A

United States Patent [19]

Wang et al.

[11] Patent Number: 5,984,838

[45] Date of Patent: Nov. 16, 1999

[54] TREADMILL WITH A PREFERRED FRAME

[75] Inventors: Leao Wang; Peter Wu, both of Taichung, Taiwan

[73] Assignee: Greenmaster Industrial Corp., Taichung, Taiwan

[21] Appl. No.: 09/048,791

[22] Filed: Mar. 27, 1998

[51] Int. Cl.[6] ..... A63B 22/02

[52] U.S. Cl. ..... 482/54

[58] Field of Search ..... 482/54

[56] References Cited

U.S. PATENT DOCUMENTS

| | | | |
|---|---|---|---|
| 4,274,625 | 6/1981 | Gaetano | 482/54 |
| 5,441,468 | 8/1995 | Deckers et al. | 482/54 |
| 5,599,259 | 2/1997 | Skowronski et al. | 482/54 |

*Primary Examiner*—Glenn E. Richmond

[57] ABSTRACT

A treadmill with a preferred frame relates to a running track frame being anchored at the two sides of the mainframe that primarily used for accommodating and stabilizing a running board. And the front and the back of the running board is coordinated with front and rear rollers, and combined with a running track to provide the user to stand on top of the running track to perform the jogging motion. At this time, the running track will start to rotate repeatedly around the perimeter of the front and rear rollers due to abrasion. The characteristic is the particular runner frame has at least one opening slot, or equipped with an open slot on one of the surfaces, while the total length of that open slots shall exceed one-half of the distance between the front and rear rollers as an optimal choice. Therefore, the existence of that opening slot is utilized to provide adequate reduction to the rigidity of the metal structure in that framework, thus reduces the counter-force and vibrations during the operation. In the mean time, it also greatly cuts down the resonating noises generated from the operation due to gravity and vibrations.

2 Claims, 2 Drawing Sheets

TREADMILL WITH A PREFERRED FRAME

BACKGROUND OF THE INVENTION

The Present invention relates to the running track of a treadmill, and more particularly relates to an adequate reduction of the counter-force that results from its operation. It can provide the user with a more comfortable sensation during exercise, and substantially reduces resonant noise at the same time.

Treadmill is an exercise apparatus that is fairly suitable for indoors application for physical training and recreation, especially for people in this modern and busy society. However, when the human body is engaged in actual jogging exercise, the joints at ankles and knees are subject to enormous pressure. If the user mistakenly selected poor-quality sneakers or a poorly designed treadmill, substantial damage may be inflicted from doing such exercise.

A majority of treadmill manufacturers are aware of the aforementioned facts, and the conditions have been focused to implement certain improvements. Nonetheless, in terms of common treadmills in the market, in order to maintain the required strength and rigidity for the treadmill, apart from extensive use of metal pipes in the framework of the structure, the frame around the perimeter of the user is mostly made of square or round hollow metal pipes, with lining along the two sides of the treadmill or a wooden running board with a plurality of rubbery types of material to compose a soft padding in an attempt to reduce the resonating phenomenon of board, and the counter-force that the frame effects on the user.

However, the soft padding does not effectively reduce the rigidity of the metal frame. Thus when the user is performing a jogging motion on the treadmill, the rigidity of frame and the counter-force generated from the running board could still be felt extensively. As a result, there is no significant reduction to the liability to the user's feet, and the hollow structure of the runner frame will be triggered by the user's repeated treading motions to generate resonating effects time that lead to extremely loud operating noise, which is believed to have been felt by users who have ever operated a treadmill.

SUMMARY OF THE INVENTION

The objective of the present invention is to provide an adequate reduction to the rigidity of the metal structure of the runner frame, to further reduce the counter-force and vibrations generated from the application. This invention provides the user with a more comfortable sensation, and also greatly reduces the injury resulting from exercise, it also greatly reduces the resonating noise generated from the operation due to gravity and vibrations.

BRIEF DESCRIPTION OF THE DRAWINGS

The forgoing and other features and advantages of the present invention will be more clearly understood from the following detailed description and the accompanying drawings, in which.

DETAILED DESCRIPTION OF THE PREFERRED EMBODIMENT

Figure 1:
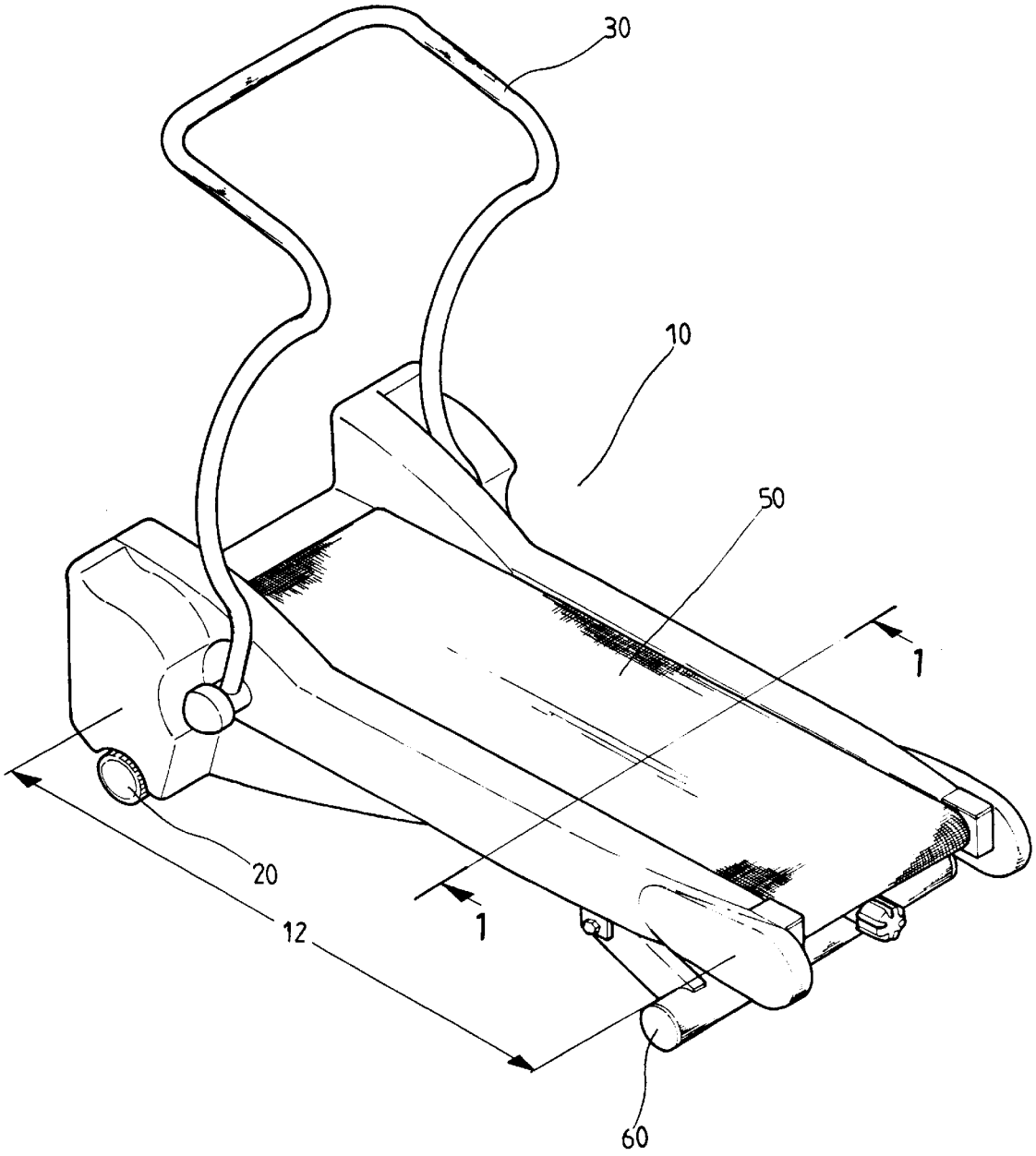
FIG. 1 is a perspective view of a treadmill according to the present invention.
Figure 2:
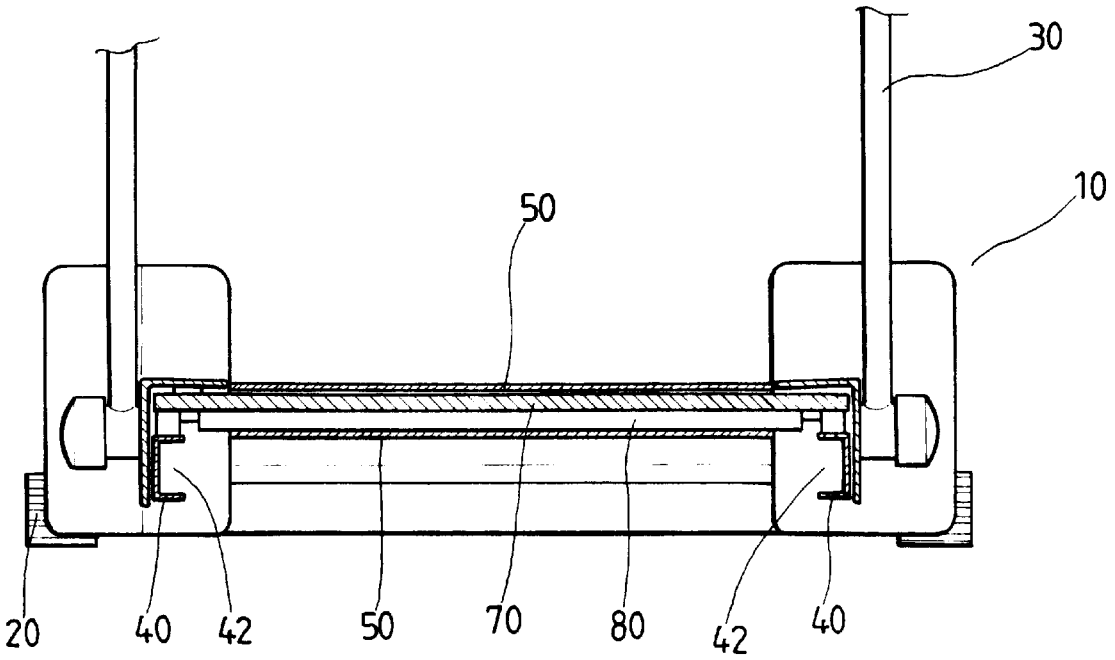
FIG. 2 is partially sectional view of the treadmill of FIG. 1. 1—1.

Referring to FIGS. 1 and 2, therein illustrated is a treadmill embodying the present invention, which is generally comprised of a mainframe 10, a front support bar 20, a handrail 30, a running track frame 40, a running track 50, and a rear support bar 60. The running track frame 40 is attached to the two sides of the mainframe 10 and is primarily used for accommodating and stabilizing a running board 70. The top and bottom of the running board 70 are coordinated with front and rear rollers 80, and the running track 50.

The feature of the component is the running track frame 40 having an open slot 42, or a groove (or hole) furnished on its side. The optimal length of the open slot shall be longer than one-half of total length 12, which is the distance between the front and rear rollers 80. The open slot is utilized to provide a reduction to the rigidity of the frame 40, further reduces the counter-force and vibrations during the operation to provide the user with a more comfortable sensation. It also greatly cuts down the resonating noises generated during the operation due to gravity and vibration.

The configuration, location, quantity and dimension for the open slot 42, or open groove (or hole) under the prerequisite of accomplishing the expected effectiveness, are not limited to any pre-defined constraints.

Naturally, to add open slots or open grooves (or hole) onto the surface of metal pipes is a rather simple processing technique. However, because such discovery and its practical effect of application has provided a positive and extensive impact towards the quality of treadmill products, and that under the prerequisite that it indeed provides a tangible effectiveness and a primary deployment by the present invention.

It is understood by those skilled in the art that the foregoing description is a preferred embodiment of the disclosed device and that various changes and modifications may be made in the invention without departing from the spirit and scope thereof.

What is claimed is:

1. A treadmill having a mainframe with opposite sides, and a front support bar and a rear support bar, and comprising:

a) front and rear rollers spaced apart a predetermined length;

b) an endless running track extending around the front and rear spaced apart rollers to form an upper run on which a treadmill user may exercise;

c) a running board located adjacent to the upper run of the endless running track; and, d) a running track frame member located adjacent to each opposite side of the mainframe, the running track frame members supporting the running board thereon, each running track frame member having a side with an opening, a length of the opening being greater than one half of the predetermined length between the spaced apart rollers so as to reduce the rigidity of the running track frame members, thereby reducing force and vibrations on a user during exercise of the treadmill.

2. The treadmill of claim 1 further comprising a handrail extending upwardly from the mainframe.

* * * * *